US007380342B2

(12) United States Patent
Huang et al.

(10) Patent No.: US 7,380,342 B2
(45) Date of Patent: Jun. 3, 2008

(54) SCISSORS HAVING SEPARATED BLADES AND HANDLES

(76) Inventors: Chien-Che Huang, 5F., No. 9-4, Lane 543, Sec. 7, Chang Lu Rd., Fu Hsing Hsiang, Chang Hua Hsien (TW); Shun-Shih Hsu, No. 46, Alley 7, Lane 444, Sec. 7, Chang Lu Rd., Fu Hsing Hsiang, Chang Hua Hsien (TW)

( * ) Notice: Subject to any disclaimer, the term of this patent is extended or adjusted under 35 U.S.C. 154(b) by 52 days.

(21) Appl. No.: 11/379,058

(22) Filed: Apr. 18, 2006

(65) Prior Publication Data

US 2007/0240315 A1 Oct. 18, 2007

(51) Int. Cl.
*B26B 13/00* (2006.01)

(52) U.S. Cl. ..... 30/194; 30/254; 30/256; 30/257; 30/259; 30/260; 30/266; 30/270; 30/341

(58) Field of Classification Search ..... 30/254, 30/256, 257, 259, 260, 266, 270, 341, 194, 30/201, 232

See application file for complete search history.

(56) References Cited

U.S. PATENT DOCUMENTS

| | | | | |
|---|---|---|---|---|
| 2,640,262 | A * | 6/1953 | Spon | 30/270 |
| 4,048,721 | A * | 9/1977 | Gunson | 30/254 |
| 5,168,629 | A * | 12/1992 | Willard | 30/231 |
| 2006/0185175 | A1* | 8/2006 | Hsieh | 30/257 |

* cited by examiner

*Primary Examiner*—Joseph J. Hail, III
*Assistant Examiner*—Robert Scruggs
(74) *Attorney, Agent, or Firm*—Leong C. Lei

(57) ABSTRACT

A pair of improved scissors is provided herein, which separates the blades and handles of the pair of scissors into individual parts. These parts are joined at the pivot point by a locking mechanism. By adjusting the locking mechanism, the included angle between the blades and handles of the pair of scissors can be varied easily in accordance the requirement of the application. In addition, with the present invention, the handles can also be replaced by those that are safer and more comfortable to operate. As such, the stress and burden of the user's fingers and wrist can be relieved in operating the pair of scissors.

8 Claims, 3 Drawing Sheets

SCISSORS HAVING SEPARATED BLADES AND HANDLES

BACKGROUND OF THE INVENTION (a) Technical Field of the Invention

The present invention generally relates to scissors, and more particularly to a pair of scissors whose blades and handles are separated and, when joined together, can have different included angles between the blades and handles for various applications.

(b) Description of the Prior Art

As shown in FIG. 5, a pair of conventional scissors consists of two sharp blades 30 screwed together. At an end of each of the blades 30, there is a handle 31 with a ring-shaped portion 32 for the penetration of fingers. Usually, each of the blades 30 and its respective handle 31 are substantially aligned in a straight line (i.e., the included angle is about 180 degrees) and made into a single object. In applications such as hair cutting, a user has to constantly and significantly twist his or her wrist in order to operate the pair of scissors in cutting the hair on the various parts of the head. This presents a serious physical burden to the barber or the hair designer. If the pair of scissors is operated continuously for an extended period of time, the user's fingers or wrist would be injured.

SUMMARY OF THE INVENTION

The primary purpose of the present invention is to provide a pair of improved scissors so as to relieve the stress and burden of the user's fingers and wrist in operating the pair of scissors.

To achieve the objective, the present invention separates the blades and handles of the pair of scissors into individual parts. To make the pair of scissors, these parts are joined at the pivot point by a locking mechanism. By adjusting the locking mechanism, the included angle between the blades and handles of the pair of scissors can be varied easily in accordance the requirement of the application. In addition, with the present invention, the handles can also be replaced by the those that are safer and more comfortable to operate.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
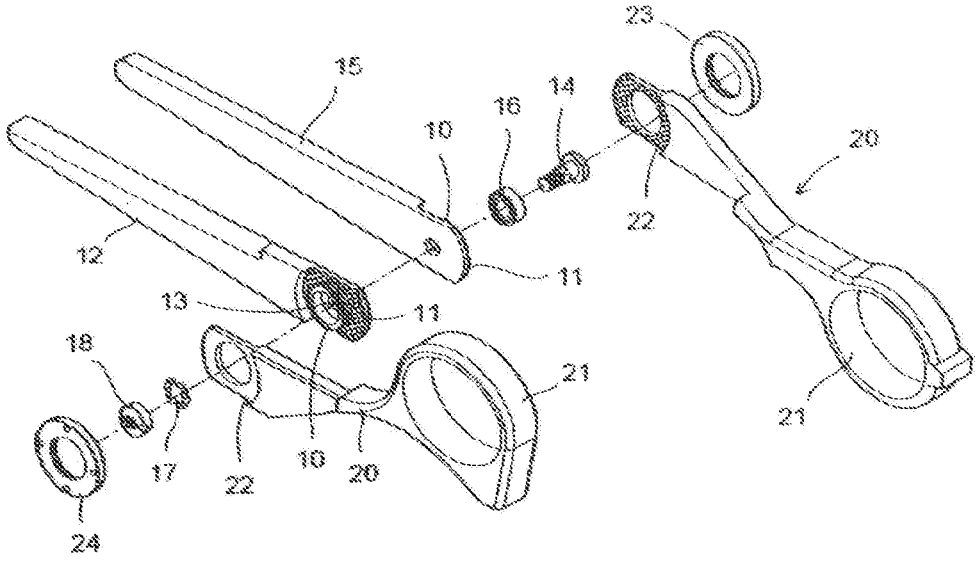
FIG. 1 is a perspective exploded view showing the pair of scissors according to an embodiment of the present invention.
Figure 2:
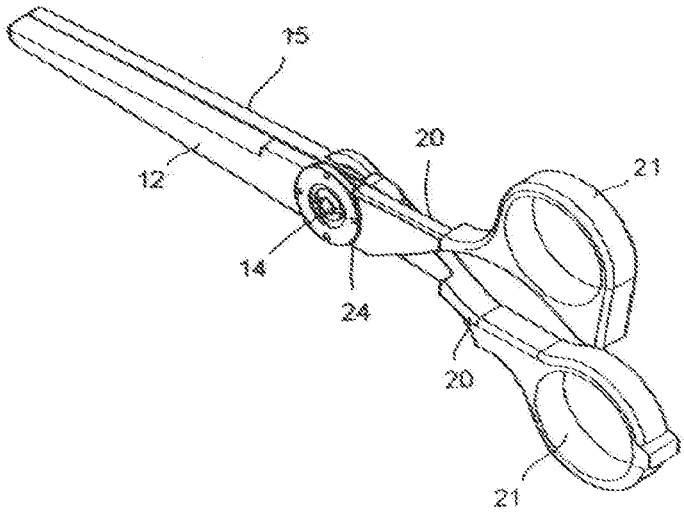
FIG. 2 is a perspective view showing the pair of scissors of FIG. 1 after its assembly.

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

As illustrated in FIGS. 1 to 4, the pair of scissors according to an embodiment of the present invention contains a first blade 15 and a second blade 12, both having a sharp top end. The first and second blades 15 and 12 are fixed together with their back sides facing each other. At a bottom end opposite to the top end of each of the blades 12 and 15, there is an indented portion 11 concaved from a front side to the back side of the blades 12 and 15. The front surfaces of the indented portions 11 are roughened appropriately. Out of the roughened surface within each indented portion 11, a ring flange 10 protrudes towards the front side for an appropriate height. Within the ring flanges 10 of the blades 12 and 15, through openings 13 are provided respectively. A pivot axle 14 is threaded through a bearing 16, the through openings 13 of the first and second blades 15 and 12 respectively, and a washer 17 in this order. A fastening nut 18 is screwed to the end of the pivot axle 14 exposed from the washer 17 to securely lock the blades 12 and 15 together. Please note that a middle section of the pivot axle 14 has a polygonal cross-section. Correspondingly, the through opening 13 of the second blade 12 (or the first blade 15 or both) also has a substantially identical polygonal aperture so that, when the fastening nut 18 is screwed onto the pivot axle 14, the pivot axle 14 will not spin along with the fastening nut 18. The most common polygonal shape is a rectangle.

The pair of scissors also contains two handles 20, both having ring-shaped portions 21 at their bottom ends respectively. Each handle 20 has a through opening at a top end 22 opposite to the ring portion 21 at the bottom end. The apertures of the through openings are provided such that the ring flanges 10 of the blades 12 and 15 can be fitted inside and exposed for an appropriate height, respectively. On a back side at the top end of each handle 20, the surface is appropriately roughened so as to produce larger friction when the handle 20 is joined to the blade 12 or 15 by fitting its through opening at the top end 22 over the ring flange 10. The roughened surfaces at the back sides of handle 20's top end 22 and at the front sides of indented portions 11 of the blade 12 and 15 can be achieved by forming parallel grooves, meshed grooves, or embossment.

Please note that there are threads and thread grooves provided on the outer surfaces around the circumferences of the ring flanges 10. Then, after the blades 12, 15, and the handles 20 are joined together as described above and as shown in the drawings, a fastening cap 23 having a cross-sectional shape of a bracket member and a fastening ring 24 are screwed to the ring flanges 10 exposed from the through openings of the handles 20. Around the inner walls of the fastening ring 24 and the fastening cap 23, there are thread grooves and threads corresponding to the threads and thread grooves on the ring flanges 10. As such, the assembly of the pair of scissors is completed.

Figure 3:
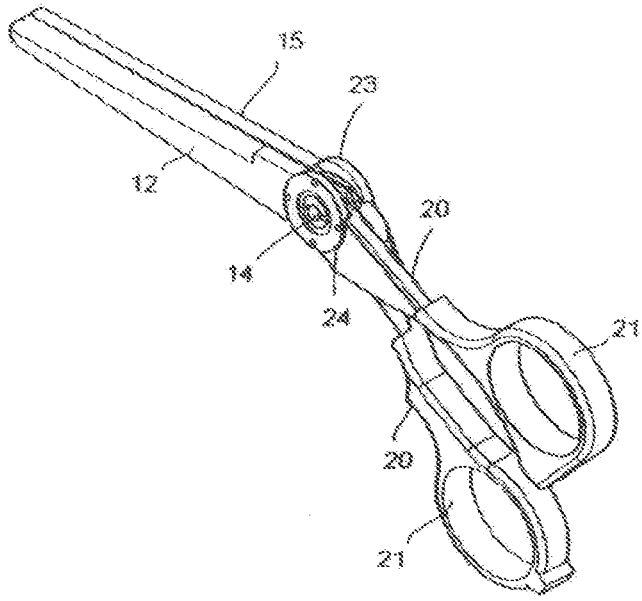
FIG. 3 is a perspective view showing the pair of scissors of FIG. 1 whose blades and handles have a smaller included angle therebetween.
Figure 5:
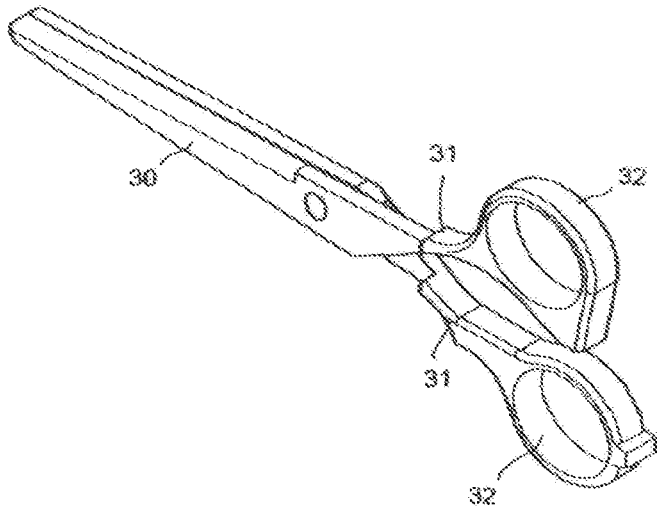
FIG. 5 PRIOR ART
FIG. 5 is a perspective view showing a pair of conventional scissors.
Figure 4:
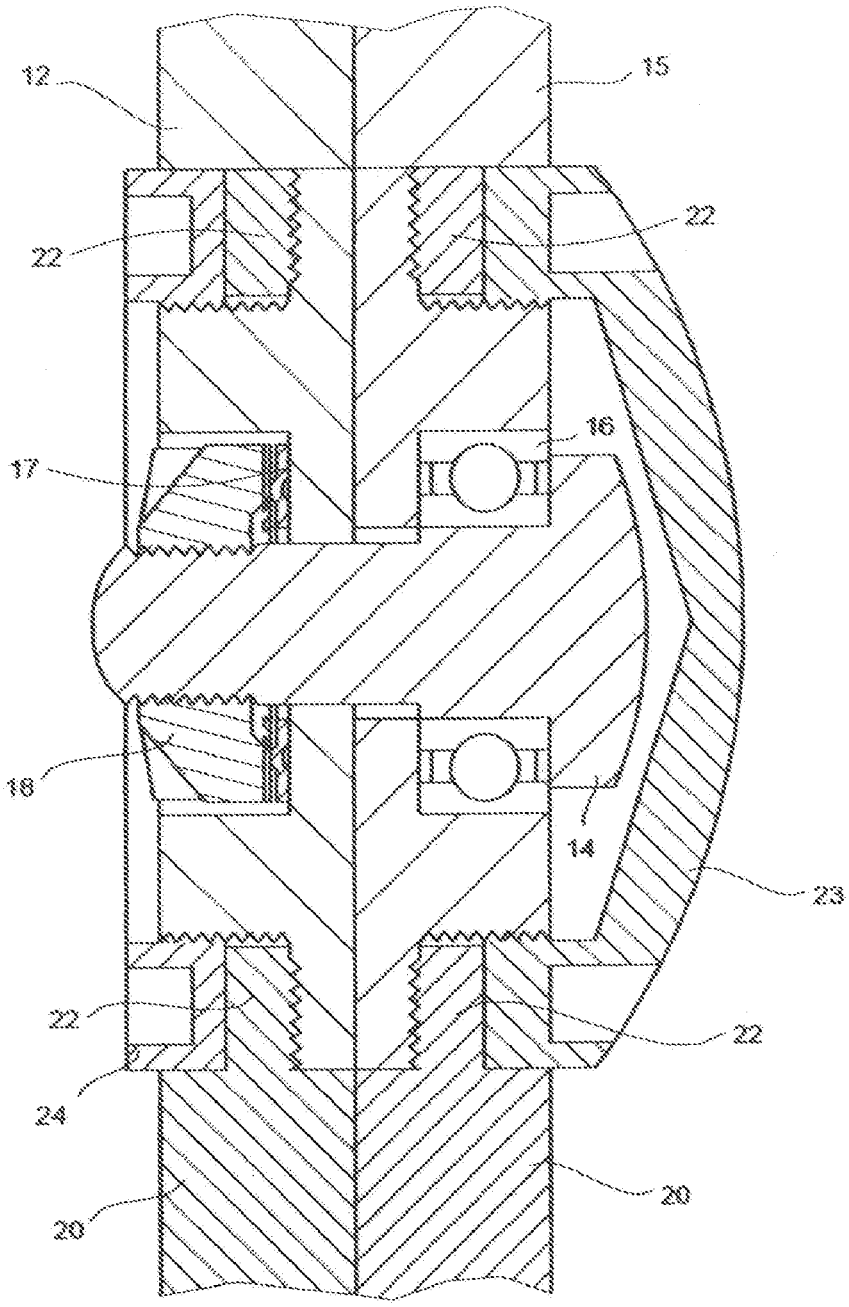
FIG. 4 is a sectional view showing the locking mechanism of the pair of scissors of FIG. 1.

The most significant feature of the present invention is that the blades 12 and 15 and the handles 20 are separated parts of the pair of scissors. The blades 12 and 15 are pin-joined together by the pivot axle 14. The fasting cap 23 reliably locks a handle 20 to the first blade 15 while the fastening ring 24 reliably locks the other handle 20 to the second blade 12. At where the blades 12 and 15 interface with the handles 20, the interfacing surfaces are roughened so as to avoid the blades 12 and 15 from sliding relative to the handles 20. As shown in FIG. 3, depending on the application requirements, the fastening cap and ring 23 and 24 can be easily loosed so as to adjust the included angles between the handles 20 and the blades 12 and 15. The fastening cap and ring 23 and 24 then can be tightened again for reliable operation of the pair of scissors. As such, less extent of twisting the wrist in operating the pair of scissors can be achieved, thereby relieving the burden and stress to the user. Additionally, if required by the application, completely different pairs of handles 20 can be joined to the same pair of blades 12 and 15, and vice versa, to achieve highest degree of comfort and easiness in operating the pair of scissors.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

We claim:

1. A pair of scissors, comprising:

a first blade and a second blade, each having an indented portion at a bottom end concaved from a front side to a back side, a ring flange protruding toward said front side within each said indented portion for an appropriate height, a through opening being provided within each said ring flange, threads and thread grooves being provided on the outer surfaces around the circumferences of said ring flanges;

a pivot axle and a fastening nut, said pivot axle threading through said through opening of said first blade, said through opening of said second blades in this order with said back sides of said first and second blades facing each other, said fastening nut being screwed to an end of said pivot axle exposed from said through opening of said second blade to Lock said first and second blades together;

a first pair of handles, each having a through opening at a top end, said through openings being provided to allow said ring flanges to be fitted inside and exposed for an appropriate height, said first pair of handles being joined to said first and second blades pin-joined by said pivot axle and fastening nut by having said through openings of said handles fitting over said ring flanges of said first and second blades respectively with said back sides of said handles facing said front sides of said first and second blades; and a fastening cap having a cross-sectional shape of a bracket member whose inner wall has thread grooves and threads corresponding to the threads and thread grooves of said ring flange of said First blade; and a fastening ring whose inner wall has thread grooves and threads corresponding to the threads and thread grooves of said ring flange of said second blade;

wherein said fastening cap is screwed to the exposed portion of said ring flange of said first blade to lock one of said first pair of handles to said first blade at an appropriate included angle therebetween; and said fastening ring is screwed to the exposed potion of said ring flange of said second blade to lock the other one of said first pair of handles to said second blade at an appropriate included angle.

2. The pair of scissors according to claim 1, wherein a middle section of said pivot axle has a polygonal cross-section; at least one of said through opening has a substantially identical polygonal aperture so as to prevent said pivot axle from spinning inside said through opening.

3. The pair of scissors according to claim 1, wherein the front surface of each indented portion is roughened appropriately; and the back surface at said top end of each said handle is appropriately roughened.

4. The pair of scissors according to claim 3, wherein the surfaces are roughened by one of the following means: forming parallel grooves, forming meshed grooves, and forming embossment.

5. The pair of scissors according to claim 1, further comprising a bearing being treaded through by said pivot axle in front of said first blade.

6. The pair of scissors according to claim 1, further comprising a washer being threaded through by said pivot axle between said second blade and said fastening nut.

7. The pair of scissors according to claim 2, wherein said polygonal shape is a rectangle.

8. The pair of scissors according to claim 1, further comprising at least a second pair of handles, each having a through opening at a top end, said through openings being provided to allow said ring flanges to be fitted inside and exposed for an appropriate height, said second pair of handles being joined to said first and second blades pin-joined by said pivot axle and fastening nut by having said through openings of said handles fitting over said ring flanges of said first and second blades respectively with said back sides of said handles facing said front sides of said first and second blades; wherein said first pair of handles are replaced by said second pair of handles.

* * * * *